US006912948B2

(12) United States Patent
Iizuka

(10) Patent No.: US 6,912,948 B2
(45) Date of Patent: Jul. 5, 2005

(54) SWASH PLATE COMPRESSOR

(75) Inventor: Jiro Iizuka, Isesaki (JP)

(73) Assignee: Sanden Corporation, Gunma (JP)

( * ) Notice: Subject to any disclaimer, the term of this patent is extended or adjusted under 35 U.S.C. 154(b) by 26 days.

(21) Appl. No.: 10/730,065

(22) Filed: Dec. 9, 2003

(65) Prior Publication Data

US 2004/0202553 A1 Oct. 14, 2004

(30) Foreign Application Priority Data

Dec. 9, 2002 (JP) ..... 2002-356393

(51) Int. Cl.[7] ..... F04B 27/08
(52) U.S. Cl. ..... 92/71; 417/269
(58) Field of Search ..... 92/12.2, 71, 165 R, 92/165 PR; 417/269

(56) References Cited

U.S. PATENT DOCUMENTS 5,140,903 A * 8/1992 Terauchi ..... 92/71
5,615,599 A * 4/1997 Terauchi ..... 92/71
5,706,716 A * 1/1998 Umemura ..... 92/71
5,816,134 A * 10/1998 Takenaka et al. ..... 92/154
6,260,469 B1 * 7/2001 Ahn ..... 92/71
6,325,599 B1 * 12/2001 Herder et al. ..... 92/71
6,422,129 B1 * 7/2002 Yokomachi et al. ..... 92/71

FOREIGN PATENT DOCUMENTS

JP 05 010255 1/1993

* cited by examiner

*Primary Examiner*—Thomas E. Lazo
(74) *Attorney, Agent, or Firm*—Baker Botts L.L.P.

(57) ABSTRACT

A swash plate compressor comprises a swash plate rotated by a drive shaft and a piston that reciprocates in a cylinder bore by the rotation of the swash plate. The piston includes a tail and a pair of shoes retained in the tail. The shoes sandwich an outer periphery of the swash plate. Each shoe has a receiving face for receiving the outer periphery of the swash plate. A central point of the receiving face is located off a common plane including an axis of the piston and that of the drive shaft.

14 Claims, 3 Drawing Sheets

COMPRESSING/DISCHARGING PROCESS

SUCKING PROCESS

SWASH PLATE COMPRESSOR

This nonprovisional application claims priority under 35 U.S.C. § 119(a) on Patent Application No. 2002-356393 filed in Japan on Dec. 9, 2002, the entire contents of which are hereby incorporated by reference.

BACKGROUND OF THE INVENTION

1. Field of the Invention

The present invention relates to a swash plate compressor incorporated into a refrigerating circuit of an air-conditioning system for a vehicle.

2. Description of the Related Art

A swash plate compressor of this type is disclosed, for example, in Unexamined Japanese Patent Application No. 5-10255. This publicly known compressor includes a cylinder block in which a plurality of cylinder bores are defined and pistons inserted in their respective cylinder bores. These pistons reciprocate in the cylinder bores in response to the rotation of a swash plate. The reciprocation of the pistons performs the process of sucking a refrigerant used in the refrigerating circuit and the process of compressing/discharging the refrigerant, and thus the compressor can supply a high-pressure refrigerant to the refrigerating circuit.

The above-described swash plate is closely sandwiched between a pair of shoes of the piston at its outer periphery, and rotates while sliding against the shoes. In relation to the swash plate, however, the shoes merely sandwich the outer periphery of the swash plate from both sides at in the axial direction of the piston. In other words, the shoes are not restricted by the outer periphery of the swash plate in view of the circumferential and radial directions of the swash plate.

On the other hand, during the rotation of the swash plate, side force is exerted on each piston in a direction perpendicular to the axis of the piston. The strength of the side force is determined by a tilt angle of the swash plate and the sliding resistance between the swash plate and the shoes.

Therefore, the side force causes the piston to press against a part of the inner circumferential surface of the cylinder bore, thus creating non-uniform abrasion of the piston and the inner circumferential surface of the cylinder bore.

In order to prevent the non-uniform abrasion, the swash plate of the compressor disclosed in the above-mentioned publication has an annular groove in each end face thereof, and the shoes are fitted into the annular grooves, respectively. In this case, the shoes relatively slide in the annular grooves according to the rotation of the swash plate, thereby being restricted in their displacement in the radial direction of the swash plate. As a result, in relation to the radial direction of the swash plate, the side force is not exerted on the piston and the no-uniform abrasion of the piston and the cylinder bore due to the side force is reduced.

The outer periphery of the swash plate, however, slides against the shoes at higher speed in the circumferential direction of the swash plate, as compared with the displacement of the piston in the radial direction thereof. For this reason, the side force exerted on the piston in the circumferential direction of the swash plate is greater than that in the radial direction of the swash plate.

Accordingly, even if the annular grooves are formed in the swash plate, it is impossible to sufficiently lessen the side force exerted on the piston, that is, the non-uniform abrasion of the piston and the cylinder bore.

On the other hand, the compressor described in the publication further includes a stopper face that restrains the rotation of the piston around its axis during the rotation of the swash plate. The stopper face is formed at one end of the piston protruding from the cylinder bore, that is, in the outer surface of a tail of the piston that retains the shoes. The stopper face has the shape of a circular arc, and this circular arc extends along the inner circumferential surface of a swash plate chamber or a crank chamber accommodating the swash plate. The stopper face slides against the inner circumferential surface of the crank chamber to allow the reciprocation of the pistons, and on the other hand restricts the rotation of the pistons.

It is very difficult, however, to bring the inner circumferential surface of the crank chamber and the stopper face into closely contact with each other, so that a small gap left-between the inner circumferential surface of the crank chamber and the stopper face is unavoidable. Consequently, during the operation of the compressor, the leading or trailing edge of the tail of the piston in view of the rotating direction of the swash plate hits on the inner circumferential surface of the crank chamber. Such collision not only vibrates the compressor but also increases the noise of the compressor.

SUMMARY OF THE INVENTION

An object of the present invention is to provide a swash plate compressor capable of reducing non-uniform abrasion of a piston and a cylinder bore due to side force exerted on the piston, or decreasing vibration and noise thereof.

The aforementioned object is achieved by a swash plate compressor of the present invention. This compressor sucks working fluid and then compresses and discharges the sucked working fluid.

More specifically, the compressor comprises: a housing defining therein a cylinder bore and a cylindrical swash plate chamber; a piston inserted into the cylinder bore, the piston including a piston axis, a tail protruding into the swash plate chamber, and a stopper face formed on the tail, for restraining rotation of the piston, the stopper face being closely located to an inner circumferential surface of the swash plate chamber and extending along the inner circumferential surface of the swash plate chamber; a driving device for causing the piston to reciprocate in the cylinder bore, the driving device including a rotatable drive shaft extending in the swash plate chamber in parallel with the piston and having a shaft axis, a swash plate mounted on the drive shaft and rotating with the drive shaft, and a pair of shoes retained in the tail of the piston, for sandwiching an outer periphery of the swash plate to convert the rotation of the swash plate into the reciprocation of the piston, the shoe having a receiving face for receiving the outer periphery of the swash plate and a central point of the receiving face, the central point being located so as to deviate from a common plane including both the piston axis and the shaft axis; and a valve device for performing a sucking process of sucking the working fluid into the cylinder bore and a compressing/discharging process of the sucked working fluid in cooperation with the reciprocation of the piston.

More specifically, the central point of the shoe deviates from the piston axis in view of a circumferential direction and/or a radial direction of the swash plate. Preferably, the central point of the shoe is located upstream of the piston axis in the rotating direction of the swash plate, and/or located inwardly from the piston axis in the radial direction of the swash plate.

According to the above-described compressor, during the compressing/discharging process of the working fluid, the working fluid compressed by the piston exerts compressive force on a head end face of the piston. On the contrary, during the sucking process of the working fluid, suction force for sucking the working fluid into the cylinder is applied to the head end face of the piston.

The compressive force and the suction force each produces reactive force on the central point of the receiving face of the corresponding shoe. The reactive force is the main factor of generation of the side force on the piston, because of the inclination of the swash plate.

In this case, when the central point of the shoe deviates from the piston axis in the circumferential direction of the swash plate, the reactive force produced by the compressive force gives a moment to the piston. Such a moment decreases the side force exerted on the piston in the circumferential direction of the swash plate. This decreases the non-uniform abrasion of the piston and cylinder bore due to the side force.

Furthermore, the reactive force generated by the suction force also gives a moment to the piston. This moment acts in a direction of increasing the side force. However, the reactive force produced by the suction force is extremely small, compared with the reactive force produced by the compressive force, so that the non-uniform abrasion caused on the piston and the cylinder bore during the sucking process is very little.

On the other hand, in the case that the central point of the shoe deviates inwardly from the piston axis in the radial direction of the swash plate, the reactive force or the side force gives the piston a moment that makes the piston rotate around the axis thereof. Accordingly, during the rotation of the swash plate, a leading or trailing edge of the stopper face of the tail of the piston in view of the rotating direction of the swash plate is pressed against the inner circumferential surface of the swash plate chamber. The leading or trailing edge of the stopper face is, therefore, maintained in constant contact with the inner circumferential surface of the swash plate chamber. As a result, the leading or trailing edge of the stopper face never collides with the inner circumferential surface of the swash plate chamber, thus reducing the vibration and noise of the compressor.

Specifically, the central point of the shoe located off the common plane is obtained by shifting the tail of the piston from the piston axis in the radial direction of the piston. The piston with such a tail does not require more working-process time and cost than a normal piston does.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirits and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION OF THE PREFERRED EMBODIMENTS

Figure 1:
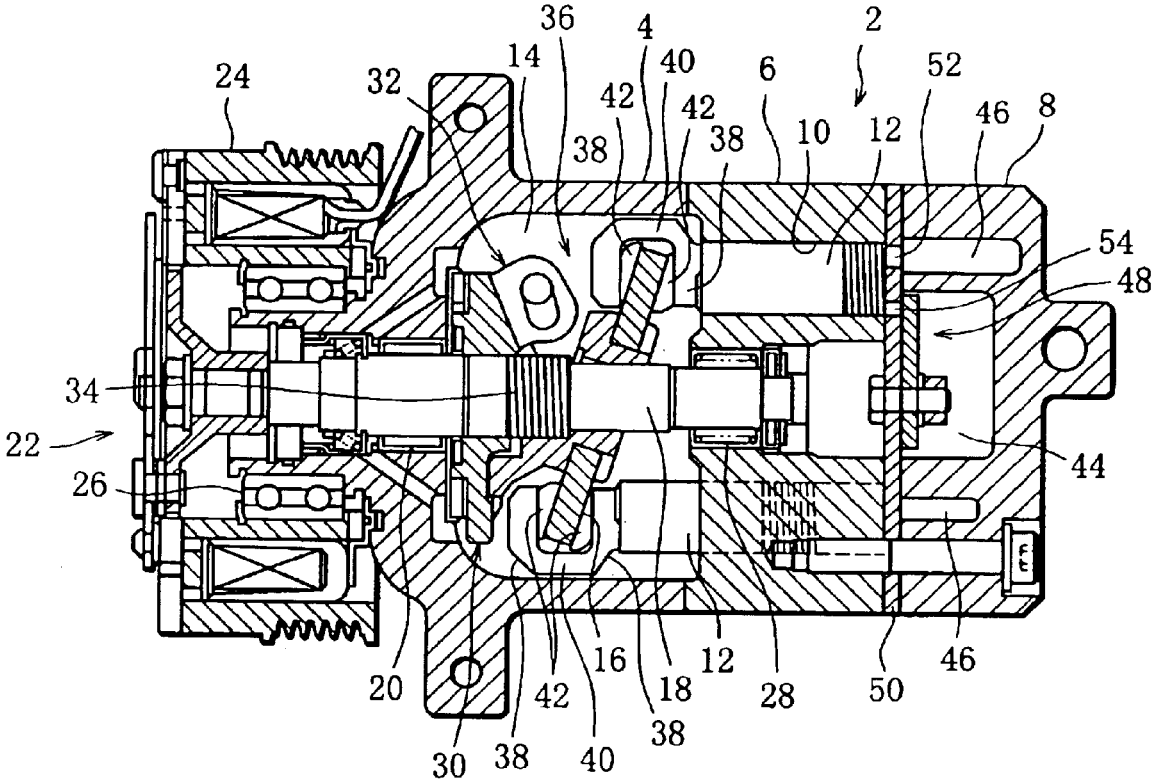
FIG. 1 is a longitudinal sectional view of a swash plate compressor.

A swash plate compressor illustrated in FIG. 1 is incorporated into a refrigerating circuit (not shown) of an air-conditioning system for a vehicle. The swash plate compressor compresses a refrigerant as working fluid utilized in the refrigerating circuit and supplies a high-pressure refrigerant to the refrigerating circuit.

The compressor comprises a cylindrical housing 2 having a crankcase 4, a cylinder block 6 and a cylinder head 8, that are arranged in order from the left side in FIG. 1.

The cylinder block 6 has a plurality of cylinder bores 10 therein. The cylinder bores 10 are arranged at regular intervals in a circumferential direction of the cylinder block 6. Inserted into each cylinder bore 10 is a piston 12 capable of reciprocating in the cylinder bore 10.

The crankcase 4 defines therein a swash plate chamber or a crank chamber 14, which accommodates a drive device. The drive device includes a swash plate 16 mounted on a drive shaft 18. The drive shaft 18 causes the swash plate 16 to rotate in one direction.

The drive shaft 18 is rotatably supported on the crankcase 4 through a radial bearing 20 and has one end protruding outside the crankcase 4. This protruding end of the drive shaft 18 is connected to a driving pulley 24 via an electromagnetic clutch 22. The driving pulley 24 is rotatably supported on the crankcase 4 through a bearing 26. The other end of the drive shaft 18 is inserted into a central hole of the cylinder block 6, and is rotatably supported on the cylinder block 6 through a radial bearing 28.

The driving pulley 24 is rotated upon receiving power from a vehicle engine. The rotation of the driving pulley 24 is transmitted through the electromagnetic clutch 22 to the drive shaft 18.

Accommodated in the crank chamber 14 is a rotor 30 that rotates with the drive shaft 18. The rotor 30 and the swash plate 16 are connected to each other with a hinge 32 therebetween. The hinge 32 allows the swash plate 16 to tilt with respect to an axis of the drive shaft 18 as a center. Furthermore, a coil spring 34 is disposed between the rotor 30 and the swash plate 16. The coil spring 34 surrounds the drive shaft 18 and presses the swash plate 16 toward the cylinder block 6 side.

Each of the pistons 12 has a tail 36. The tails 36 are formed integrally with their respective pistons 12 and protrude into the crank chamber 14. Each tail 36 includes a pair of shoe retainers 38 separated from each other in an axial direction of the piston 12, and a bridge 40 for connecting the shoe retainers 38. More specifically, the bridge 40 couples outer ends of the shoe retainers 38 situated outside the swash plate 16 in a radial direction of the swash plate 16 and extends along the inner circumferential surface of the crank chamber 14 in the axial direction of the piston 12. Accordingly, the tail 36 has a U-shape that opens inwardly in a radial direction of the swash plate 16.

The swash plate 16 is slidably sandwiched at the outer periphery thereof between the shoe retainers 38 of the tail 36 of each piston 12 through a pair of shoes 42. These shoes 42 are retained in their respective shoe retainers 38 by means of spherical bearings.

According to the above-described compressor, once the rotating force of the pulley 24 is transmitted through the electromagnetic clutch 22 to the drive shaft 18, the drive shaft 18 rotates with the rotor 30 and the swash plate 16 in one direction. Such rotation of the swash plate 16 makes the pistons 12 reciprocate in the cylinder bore 10. The stroke of the piston 12 is determined by a tilt angle of the swash plate 16.

A valve device is disposed in the housing 2. The valve device includes a discharge chamber 44 and a suction chamber 46 defined in the cylinder head 8. The discharge chamber 44 is located in the center of the cylinder head 8 and connected to a condenser of the refrigerating circuit. The suction chamber 46 is formed into an annular shape surrounding the discharge chamber 44 and connected to an evaporator of the refrigerating circuit.

The valve device further includes a valve assembly 48 having a valve plate 50 sandwiched in between the cylinder block 6 and the cylinder head 8. The valve plate 50 has a suction port 52 and a discharge port 54 for each cylinder bore 10.

The valve assembly 48 further includes a suction lead valve for opening/closing the suction port 52 and a discharge lead valve for opening/closing the discharge port 54. These lead valves are operated according to the reciprocation of the piston 12. In addition, the suction and discharge lead valves are not clearly illustrated in FIG. 1.

More specifically, the movement of the piston 12 toward the crank chamber 14 increases the volume of a compression chamber, that is defined between a head of the piston 12 and the valve plate 50, and causes the suction lead valve to open the suction port 52. As a result, a refrigerant is sucked from the suction chamber 46 through the suction port 52 into the compression chamber.

Thereafter, when the piston 12 is moved in a direction of decreasing the volume of the compression chamber, the piston 12 pressurizes the refrigerant in the compression chamber while compressing the refrigerant. When the pressure of the refrigerant overcomes the closing force of the discharge lead valve, the discharge lead valve opens the discharge port 54. At this point, a high-pressure refrigerant is discharged from the compression chamber through the discharge port 54 into the discharge chamber 44.

A part of the refrigerant discharged into the discharge chamber 44 is introduced into the crank chamber 14 through a regulating valve 8 (not shown). The pressure applied to an effective pressurized area of the piston 12 of the tail side, namely a back pressure to the piston 12, is determined by the pressure in the crank chamber 14 and the urging force of the coil spring 34. Differential pressure between the back pressure to the piston 12 and the suction pressure of the refrigerant in the suction chamber 52 determines the tilt angle of the swash plate 16, or the stroke of the piston 12. Therefore, the adjustment to the pressure in the crank chamber 14 by means of the regulating valve varies the stroke of the piston 12, that is, a discharge amount of the high-pressure refrigerant from the compressor.

Figure 2:
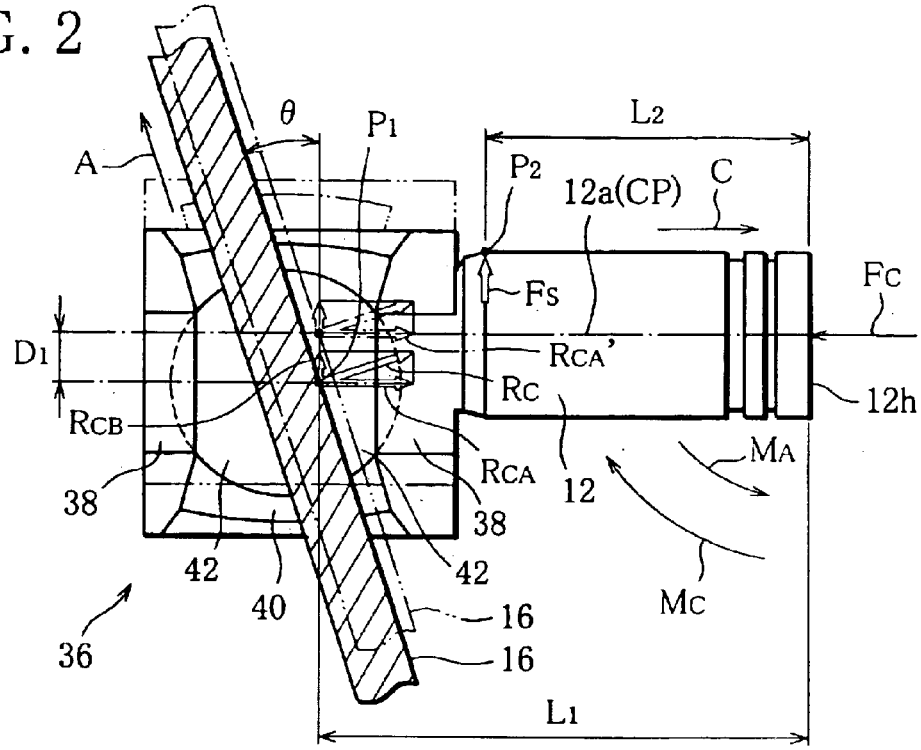
FIG. 2 is a view showing a piston in a compressing/discharging process.
Figure 3:
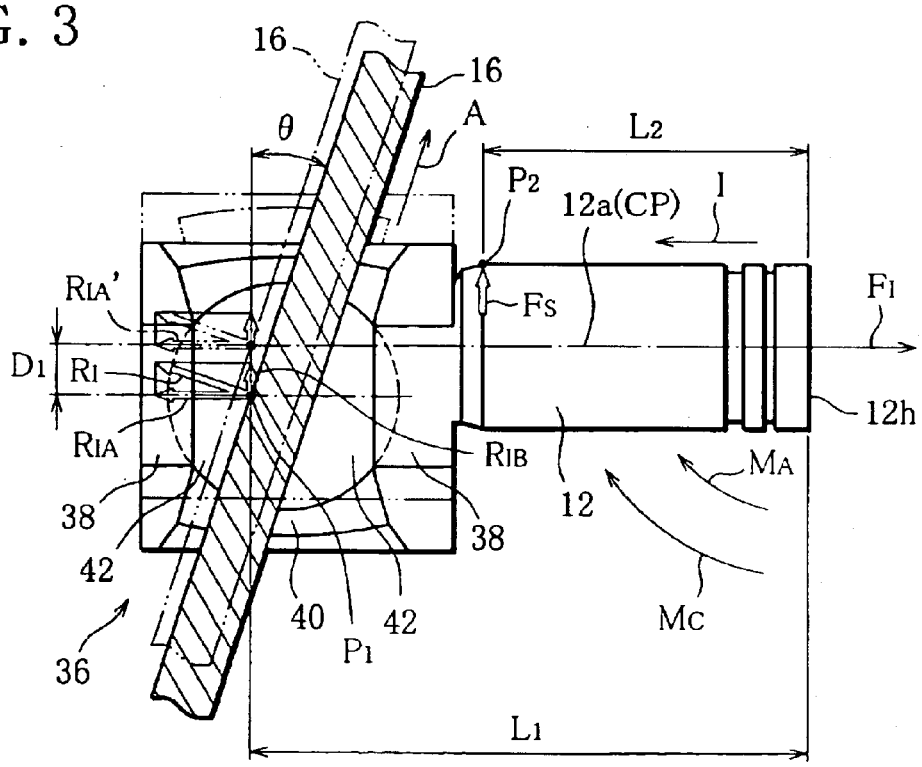
FIG. 3 is a view showing the piston in a sucking process.

FIGS. 2 and 3 illustrate the arrangement of the tail 36 in relation to the axis of the piston 12 together with the swash plate 16 in details, the arrangement being viewed from the drive shaft 18 side. In more details, FIG. 2 shows the piston 12 in the compressing/discharging process or the compression stroke thereof. In this case, an outer periphery of the swash plate 16 moves in a direction of an arrow A and the piston 12 is thus moved in a direction of an arrow C in FIG. 2. On the other hand, FIG. 3 illustrates the piston 12 in the sucking process or the suction stroke thereof. In this case, the piston 12 is moved in a direction of an arrow I in FIG. 3.

As is obvious from FIGS. 2 and 3, the tail 36 of the piston 12 is so located as to deviate from the axis 12*a* of the piston 12 in a radial direction of the piston 12.

When a receiving face of one of the shoes 42 that receives force from the swash plate 16 during the rotation of the swash plate 16 is focused, a central point of the receiving face represented by $P_1$ is located off a common plane CP. The common plane CP includes both the axis 12*a* of the piston 12 and the axis of the drive shaft 18.

More specifically, the central point $P_1$ deviates from the axis 12*a* of the piston 12 in the circumferential direction of the swash plate 16 by a predetermined distance. Specifically, in the case of this embodiment, the central point $P_1$ deviates upstream from the axis 12*a* by a predetermined distance $D_1$ in the rotating direction of the swash plate 16.

In FIGS. 2 and 3, the distance between the central point $P_1$ and a head end face 12*h* of the piston 12 is represented by $L_1$ and the distance between the head end face 12*h* and a contact point $P_2$ is represented by $L_2$. The contact point $P_2$ denotes a location where an opening edge of the cylinder bore 10 to the crank chamber 14 is brought into contact with the outer peripheral surface of the piston 12.

When the piston 12 is moved in the direction of the arrow C according to the rotation of the swash plate 16 in the compressing/discharging process shown in FIG. 2, the head end face 12*h* of the piston 12 receives compressive force $F_C$ from the compressed refrigerant. Meanwhile, reactive force $R_C$ against the compressive force $F_C$ is produced at the central point $P_1$ of the receiving face of one of the shoes 42, namely the right shoe 42 in FIG. 2, perpendicularly to the receiving face.

Herein, the swash plate 16 or the receiving face of the shoe 42 is inclined at a tilt angle θ with respect to a plane parallel to a cross section of the piston 12. Therefore, the reactive force $R_C$ produced on the receiving face can be divided into component force $R_{CA}$ parallel with the axis 12*a* of the piston 12 and component force $R_{CB}$ parallel with the cross-section of the piston 12 or along the circumferential direction of the swash plate 16.

Since the component force $R_{CB}$ tilts the piston 12, pushing force $F_S$ against the opening edge of the cylinder bore 10 is exerted on the piston 12 as side force at the contact point $P_2$ of the piston 12. The pushing force $F_S$ is expressed by the following formula on the basis of a relation between a supporting point and a power point with respect to the piston 12.

$$F_s = R_{CB} \times (L_1/L_2)$$

The side force of the piston 12 is not produced only by the component force $R_{CB}$, and a part of the side force is produced also by sliding resistance between the shoes 42 and the swash plate 16.

As described above, the contact point $P_2$ is separated from the head end face 12*h* of the piston 12 only at a distance $L_2$, so that a moment $M_C$ generated by the pushing force $F_S$ acts upon the piston 12. Therefore, the moment $M_C$ is expressed by the following formula.

$$M_C = F_S \times L_2$$

As mentioned above, since the central point $P_1$ is away from the axis 12*a* of the piston 12 only at the distance $D_1$, a moment $M_A$ generated by the component force $R_{CA}$ also acts upon the piston 12. The moment $M_A$ is expressed by the following formula.

$$M_A = R_{CA} \times D_1$$

Such a moment $M_A$ acts in a reverse direction to the moment $M_C$ and works to counteract the pushing force $F_S$ serving as the side force. This reduces the side force of the piston 12 and securely prevents the non-uniform abrasion of the piston 12 and the cylinder bore 10.

The piston 12 and the cylinder bore 10 are thus improved in durability. As a result, surface treatment for preventing the non-uniform abrasion of the piston 12 and the cylinder bore 10 may be omitted, resulting in an inexpensive working process for the piston 12 and the cylinder bore 10.

In the case that the central point $P_1$ of the receiving face of each shoe 42 is located on the axis 12*a* of the piston 12, component force $R_{CA}'$ of the reactive force $R_C$ acts upon the axis 12*a* of the piston 12 as illustrated in FIG. 2. Therefore, the moment $M_A$ is not generated, making it impossible to reduce the side force of the piston 12.

In the sucking process illustrated in FIG. 3, the piston 12 is moved in the direction of the arrow I shown in FIG. 3 according to the rotation of the swash plate 16. In this case, the suction force $F_1$ acts upon the head end face 12*h* of the piston 12 in the reverse direction to the compressive force $F_C$.

Reactive force $R_I$ against the suction force $F_I$ is produced at the central point $P_1$ of the receiving face of one of the shoes 42, that is, the left shoe 42 in FIG. 3. Since the swash plate 16 is oblique at the tilt angle θ, the pushing force $F_S$ produced by component force $R_{IB}$ of the reactive force $R_I$ is exerted on the contact point $P_2$ of the piston 12 in the same manner as in the above-described compressing/discharging process.

Furthermore, since the central point $P_1$ is apart from the axis 12*a* of the piston 12 at the distance $D_1$, the moment $M_A$ generated by the component force $R_{IA}$ of the reactive force $R_I$ acts upon the piston 12. Herein, on the contrary to the case of the compressing/discharging process, the direction of the moment $M_A$ is reverse to that of a moment $M_C$ generated by the component force $R_{IB}$.

However, since the reactive force $R_I$ against the suction force $F_I$ is extremely small, compared with the reactive force $R_C$ against the compressive force $F_C$, the pushing force $F_S$ exerted on the contact point $P_2$ of the piston 12 is small. Furthermore, even if the moments $M_C$ and $M_A$ act upon the piston 12 in the same direction, the non-uniform abrasion of the piston 12 and the cylinder bore 10 due to the side force is extremely small.

If the central point $P_1$ is located on the axis 12*a* of the piston 12, the component force $R_{IA}'$ of the reactive force $R_1$ acts upon the axis 12*a* of the piston 12 as in the case of the compressing/discharging process. Therefore, the moment $M_A$ is not generated.

Figure 4:
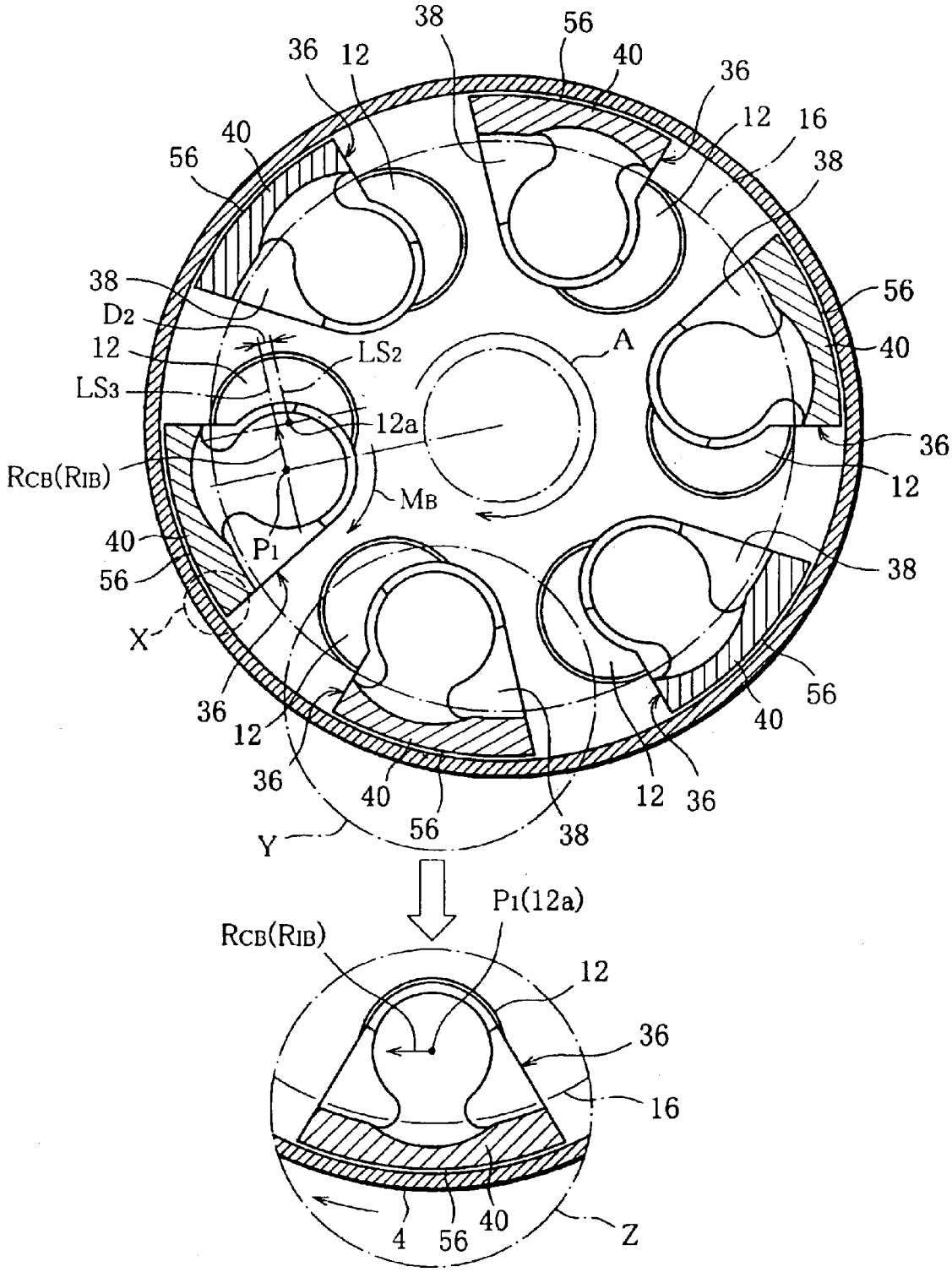
FIG. 4 is a view showing an arrangement of tails of pistons in view of an inner circumferential surface of a crank chamber in the compressor.

Referring to FIG. 4, the tail 36 of each piston 12 has a stopper face 56 for preventing the rotation of the piston 12 around the axis thereof. More specifically, the stopper face 56 is formed on the outer surface of the bridge 40 of the tail 36 and extends along the inner circumferential surface of the crank chamber 14, with a small gap therebetween. In other words, the stopper face 56 has substantially the same curvature radius as the inner circumferential surface of the crank chamber 14.

Accordingly, when the piston 12 is reciprocated, the stopper face 56 slides on the inner circumferential surface of the crankcase 4 and prevents the rotation of the piston 12 around the axis thereof.

In the case of this embodiment, as is apparent from FIG. 4, the central point $P_1$ deviates not only from the common plane CP but also deviates inwardly or outwardly from the axis 12*a* of the piston 12 in the radial direction of the swash plate 16. In the case of this embodiment, the central point $P_1$ deviates inwardly from the axis 12*a* by a predetermined distance $D_2$ in the radial direction of the swash plate 16.

Consequently, the distance D2 separates a line segment $LS_1$ from a line segment $LS_2$ as shown in FIG. 4. The line segment $LS_1$ is parallel to the component force $R_{CB}$ ($R_{IB}$) of the reactive force $R_C$ ($R_I$) and passes the central point $P_1$. The line segment $LS_2$ is parallel to the line segment $LS_1$ and passes the axis 12*a* of the piston 12. Thus, a moment $M_B(=R_{CB}(R_{IB})\times D_2)$, that is generated by the component force $R_{CB}$ ($R_{IB}$), acts upon the piston 12 and encourages the rotation of the piston 12 around the axis 12*a* thereof (clockwise direction in FIG. 4).

As a result, in view of the rotating direction of the swash plate 16, the leading edge of the stopper face 56, or that of the tail 36 (portion encircled by a dashed circle X in FIG. 4), is constantly pressed against the inner circumferential surface of the crankcase 4. Therefore, the leading or trailing edge of the stopper face 56 never hits on the inner circumferential surface of the crankcase 4. This prevents vibration and noise attributable to a collision of the leading or trailing edge of the tail 36 with the inner circumferential surface of the crankcase 4, thus improving quietness of the compressor.

In FIG. 4, a portion which is encircled by a circle Z of a chain-dashed line is illustrated as a comparative example and corresponds to a portion encircled by a circle Y of a chain-dashed line. The piston 12 in the circle Z has the axis 12*a* passing the central point $P_1$. The moment $M_B$ is not generated in this case, so that the leading or trailing edge of the tail 36 hits on the inner circumferential surface of the crankcase 4, and this collision accounts for vibration and noise of the compressor.

During the operation of the compressor, the tail 36 constantly receives the moment $M_B$, and only the leading edge of the stopper face 56 slides on the inner circumferential surface of the crankcase 4. It is therefore not necessary to take into account the contact between the trailing edge of the stopper face 56 and the inner circumferential surface of the crankcase 4. As a result, it is possible to shorten the length of the stopper face 56 along the inner circumferential surface of the crankcase 4. This enables miniaturization of the tail 36, that is, a weight saving in the compressor, and lowers the cost of the compressor.

The above-described advantages can be obtained by forming the tail 36 integrally with the piston 12 so as to deviate from the axis 12*a* of the piston 12 in the radial direction of the piston 12. According to the piston 12 having the tail 36 formed in this way, the central point $P_1$ of the receiving face of the shoe 42 can deviate from the common plane CP without difficulty.

Compared to a normal piston, the piston 12 having the above-described tail 36 neither increases time and cost for working process thereof nor requires a serious modification in a construction of the compressor.

Although the present invention is applied to the swash plate compressor of a variable displacement type, it is apparent that the present invention is also applicable to a swash plate compressor of a fixed displacement type.

What is claimed is:

1. A swash plate compressor for sucking working fluid and then compressing/discharging the sucked working fluid, the compressor comprising:

a housing defining therein a cylinder bore and a cylindrical swash plate chamber;

a piston inserted into the cylinder bore, said piston including:

a piston axis, a tail protruding into the swash plate chamber, and a stopper face formed on the tail, for preventing said piston from rotating around the piston axis, the stopper face being located adjacently to an inner circumferential surface of said swash plate chamber and extending along a circumferential direction of the swash plate chamber;

a driving device for causing said piston to reciprocate in the cylinder bore, said driving device including:

a rotatable drive shaft extending in the swash plate chamber in parallel with said piston and having a shaft axis, a swash plate mounted on the drive shaft and rotating with the drive shaft, and a pair of shoes retained in the tail of said piston, for sandwiching the swash plate at an outer periphery thereof to convert the rotation of the swash plate into the reciprocation of said piston, the shoe having a receiving face for receiving the outer periphery of the swash plate and a central point of the receiving face located so as to deviate from a common plane, the common plane including both the piston axis and the shaft axis; and a valve device for performing a sucking process of sucking the working fluid into the cylinder bore and a compressing/discharging process of the sucked working fluid in cooperation with the reciprocation of said piston.

2. The compressor according to claim 1, wherein:

the central point deviates from the piston axis in the circumferential direction of the swash plate.

3. The compressor according to claim 2, wherein:

the central point is located upstream of the piston axis in view of a rotating direction of the swash plate.

4. The compressor according to claim 3, wherein:

the central point further deviates from piston axis in view of a radial direction of the swash plate.

5. The compressor according to claim 4, wherein:

the central point is located inwardly from the piston axis in the radial direction of the swash plate.

6. The compressor according to claim 2, wherein:

the central point further deviates from the piston axis in view of a radial direction of the swash plate.

7. The compressor according to claim 6, wherein:

the central point is located inwardly from the piston axis in the radial direction of the swash plate.

8. The compressor according to claim 1, wherein:

the central point deviates from the piston axis in view of a radial direction of the swash plate.

9. The compressor according to claim 8, wherein:

said central point is located inwardly from the piston axis in the radial direction of the swash plate.

10. The compressor according to claim 9, wherein:

the central point deviates from the piston axis in view of a circumferential direction of the swash plate.

11. The compressor according to claim 10, wherein:

the central point is located upstream of the piston axis in the rotating direction of the swash plate.

12. The compressor according to claim 8, wherein:

the central point deviates from the piston axis in view of a circumferential direction of the swash plate.

13. The compressor according to claim 12, wherein:

the central point is located upstream of the piston axis in the rotating direction of the swash plate.

14. The compressor according to claim 1, wherein:

the tail of said piston deviates from the piston axis in view of a radial direction of said piston so that the central point is located off the common plane.

* * * * *